US007975803B2

(12) United States Patent
Schwoerer

(10) Patent No.: US 7,975,803 B2
(45) Date of Patent: Jul. 12, 2011

(54) DISMANTLABLE SCAFFOLD AND A RAILING ADAPTER FOR IT

(75) Inventor: Arthur Schwoerer, Senden (DE)

(73) Assignee: Peri GmbH, Weissenhorn (DE)

( * ) Notice: Subject to any disclaimer, the term of this patent is extended or adjusted under 35 U.S.C. 154(b) by 1218 days.

(21) Appl. No.: 10/481,074

(22) PCT Filed: Jun. 13, 2002

(86) PCT No.: PCT/EP02/06509

§ 371 (c)(1),
(2), (4) Date: Jun. 9, 2004

(87) PCT Pub. No.: WO02/103136

PCT Pub. Date: Dec. 27, 2002

(65) Prior Publication Data

US 2004/0231922 A1 Nov. 25, 2004

(30) Foreign Application Priority Data

Jun. 15, 2001 (DE) ..... 101 28 955

(51) Int. Cl.
*E04G 7/00* (2006.01)

(52) U.S. Cl. ..... 182/178.1; 182/113; 182/186.8; 403/49

(58) Field of Classification Search ..... 182/113, 182/178.1, 186.7, 186.8; 403/49
See application file for complete search history.

(56) References Cited

U.S. PATENT DOCUMENTS

| | | | | |
|---|---|---|---|---|
| 3,837,427 | A * | 9/1974 | Mattinson | 182/115 |
| 4,039,264 | A * | 8/1977 | Sharp | 403/246 |
| 5,070,965 | A * | 12/1991 | Jordan, III | 182/113 |
| 5,127,757 | A * | 7/1992 | Langer | 403/49 |
| 6,027,276 | A * | 2/2000 | Schworer | 403/49 |
| 6,062,341 | A * | 5/2000 | Frank et al. | 182/113 |

FOREIGN PATENT DOCUMENTS

| | | | |
|---|---|---|---|
| DE | 2822676 | A1 | 11/1979 |
| DE | 19633092 | A1 | 2/1998 |
| DE | 10111976 | A1 | 9/2002 |
| EP | 0004179 | A1 | 9/1979 |
| EP | 0147496 | A1 * | 7/1985 |
| EP | 0876541 | B1 | 1/1997 |
| FR | 2727454 | A1 | 5/1996 |
| WO | WO 97/27372 | A1 | 7/1997 |
| WO | WO 02/072977 | A1 | 9/2002 |

* cited by examiner

*Primary Examiner* — Alvin C Chin-Shue

(74) *Attorney, Agent, or Firm* — Kilpatrick Townsend & Stockton LLP

(57) ABSTRACT

The invention relates to dismantlable scaffolding comprising accessible platforms on a plurality of levels and a multitude of vertical supports carrying said platforms. Said vertical supports preferably consist of several sections which can be fixed one on top of the other, are arranged at a distance from each other, and are preferably connected by means of platform bars at predetermined vertical distances. Said supports carry perforated anchor plates at predetermined vertical distances. Connecting railing elements can be applied to adjacent vertical supports. In order to apply at least one railing element above a platform, at least the highest railing elements of a level can be applied to the associated perforated anchor plate by means of a railing adapter element. When applied to the perforated anchor plate, said adapter carries a railing holding element above the anchor plate. The distance between the anchor plate and the railing holding element is smaller than the distance between two vertically adjacent anchor plates.

2 Claims, 7 Drawing Sheets

DISMANTLABLE SCAFFOLD AND A RAILING ADAPTER FOR IT

BACKGROUND OF THE INVENTION

The invention relates to a dismantlable scaffold with safety railings for a given deck that can be hung from the deck below.

A dismantlable scaffold is already known from WO 97/27372 having rosettes which are attached to vertical supports and in whose openings horizontally arranged struts can be hung by means of hook and wedge mechanisms provided at their ends, with the hook and wedge mechanisms effecting an automatic latching with the associated rosette.

A dismantlable scaffold is known from FR-A-27 27 454 in which a horizontally arranged tube not provided with any special fastening means at the end can be fastened to a rosette carried by a vertical support via an apparatus in the manner of a joiner's clamp.

EP 0 004 179 A shows a dismantlable scaffold in which horizontally arranged tubes having hook-like fastening means at the ends can be connected to a clamping mechanism provided at a vertical strut.

DE 196 33 092 A1 shows a dismantlable facade scaffold in which railing elements can be hung to a railing holding element attached directly to a vertical strut from the deck lying below it.

SUMMARY OF THE INVENTION

It is an object of the present invention to provide a dismantlable scaffold and a railing adapter of the kind initially named which permit the attachment of the railing elements from the deck lying below even when the fastening means at the ends of the railing elements are not suitable for this purpose.

In this manner, railing elements with fastening means at the ends which are per se not suitable for the hanging into rosettes from the deck lying below can be hung on the railing holding elements of the adapter, which was previously fastened to the associated rosette, from the deck lying below.

The invention further permits the only railing element, or at least the topmost railing element, to be able to be attached to the associated vertical support above a deck at a spacing above the associated floor deck which is not restricted by the predetermined spacing of the rosettes. The invention thus provides a railing adapter with which a railing element can be fastened to a rosette at a desired spacing from it.

The railing adapter in accordance with the invention thus satisfies a dual function in that it can be matched to any desired railing elements and ensures a desired spacing of these railing elements above the associated rosette.

In one embodiment of the invention, screw connections are dispensed with and the connection is brought about in an extremely simple manner by wedging or clamping a railing adapter between an outer rim of a hole of the rosette and the periphery of the vertical support.

Another embodiment of the invention has the advantage that the strains of the railing elements which above all act externally are transferred particularly well to the vertical supports.

A further embodiment of the invention ensures in a particularly expedient manner a suitable spacing between the railing holding element and the rosette.

In yet another embodiment of the invention, fitting of the railing adapter is substantially simplified with respect to a screw mechanism by a design using a hook and wedge mechanism, in particular in accordance with EP 0 876 541 B1. An attachment of the railing adapter to a rosette is ensured which is as simple, secure and solid as possible, but nevertheless releasable. In this manner, the railing adapter only has to be placed onto the rosette from above and inserted into one of the holes thereof, with the wedge fixing the rail adapter automatically entering into the associated hole of the rosette and thus fixing the railing adapter.

The railing holding element of the present invention permits in a preferred manner the attachment of railing elements which are not actually suitable for a direct connection to a rosette. The railing adapter in accordance with the invention thus not only ensures the attachment of railing elements at a desired spacing above the associated rosette, but also provides the opportunity of using any desired railing holding elements which are matched to the securing demands of a desired railing element.

Another aspect of the present invention ensures that the railing holding element does not project over the outer periphery of the rosette, or not too far thereover.

A particularly compact and stable embodiment of the present invention involves a housing, formed as a solid base body, that is supported both vertically at the rosette and horizontally at the periphery of the vertical supports. The aforementioned hook and wedge mechanism effects the wedging provided for a fixed seat in this process.

In accordance with a further development of the present invention, the railing adapter is additionally supported at the vertical support at the height of the attachment of the railing holding element.

The invention will be described in the following by way of example with reference to the drawings.

DESCRIPTION OF THE PREFERRED EMBODIMENTS

Figure 1:
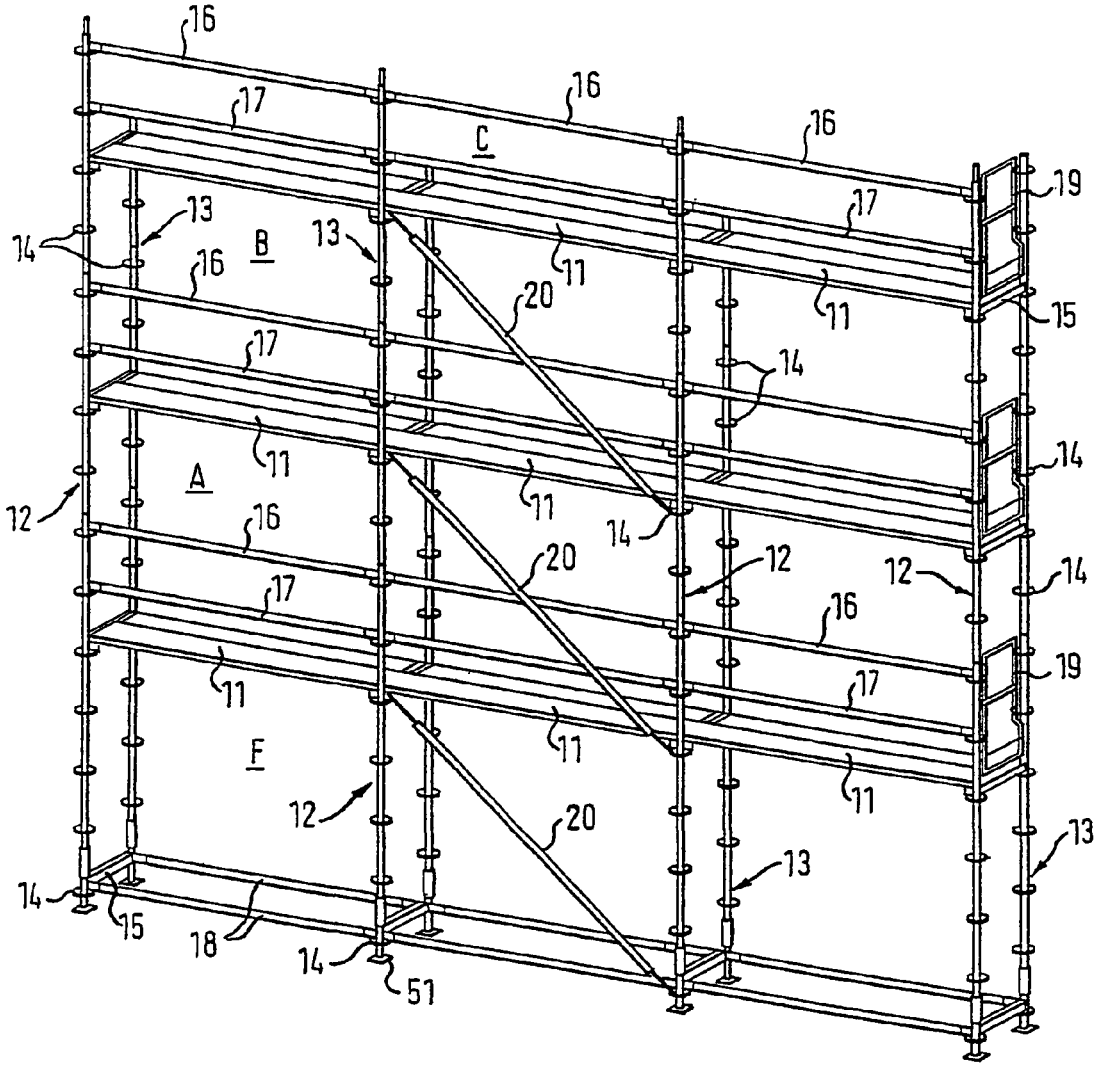
FIG. 1 is a perspective view of a dismantlable facade scaffold corresponding to the prior art in which the invention can be used.
Figure 2:
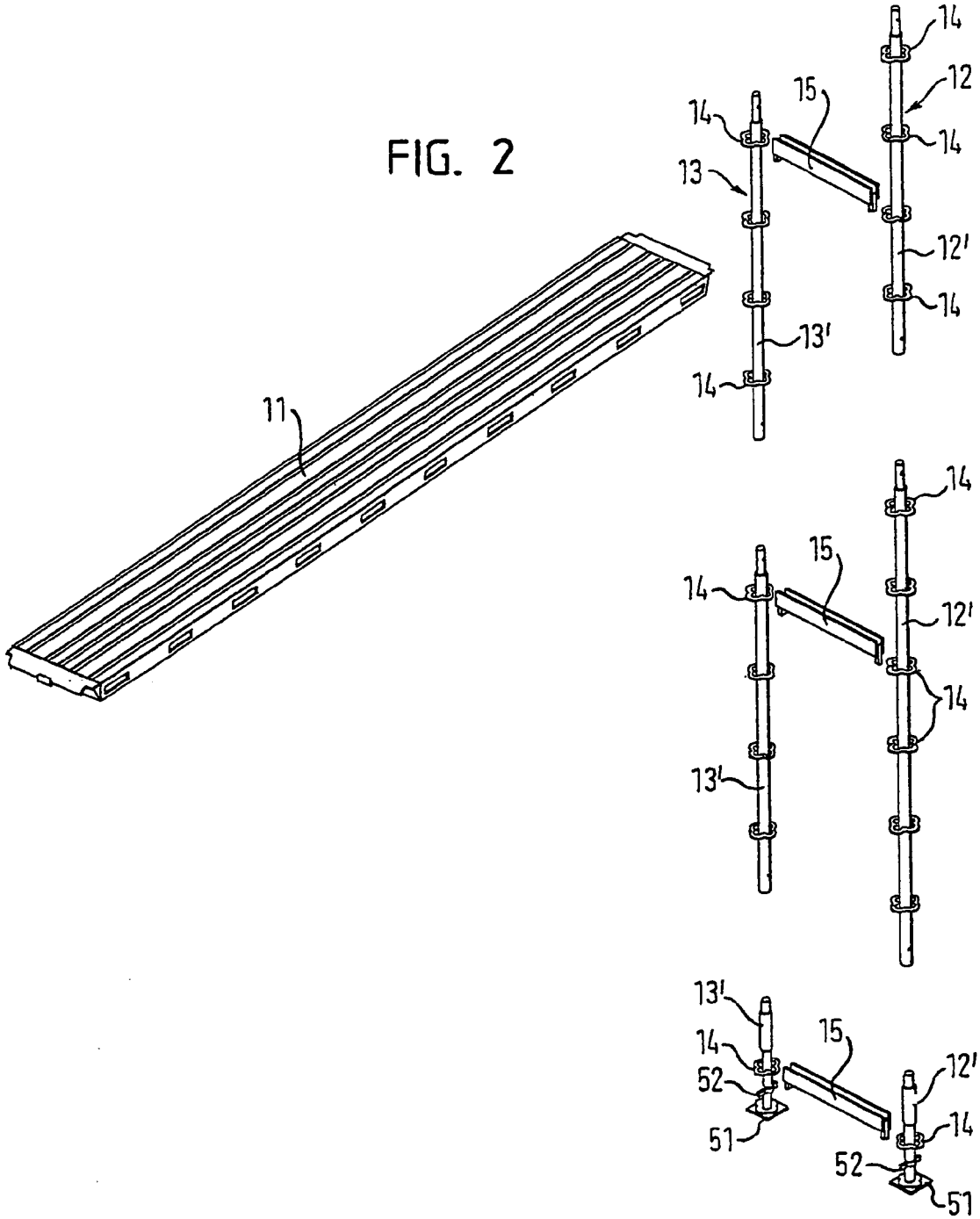
FIG. 2 is a perspective partly exploded representation at an enlarged scale for the illustration of specific individual parts of the scaffold in accordance with FIG. 1.
Figure 3:
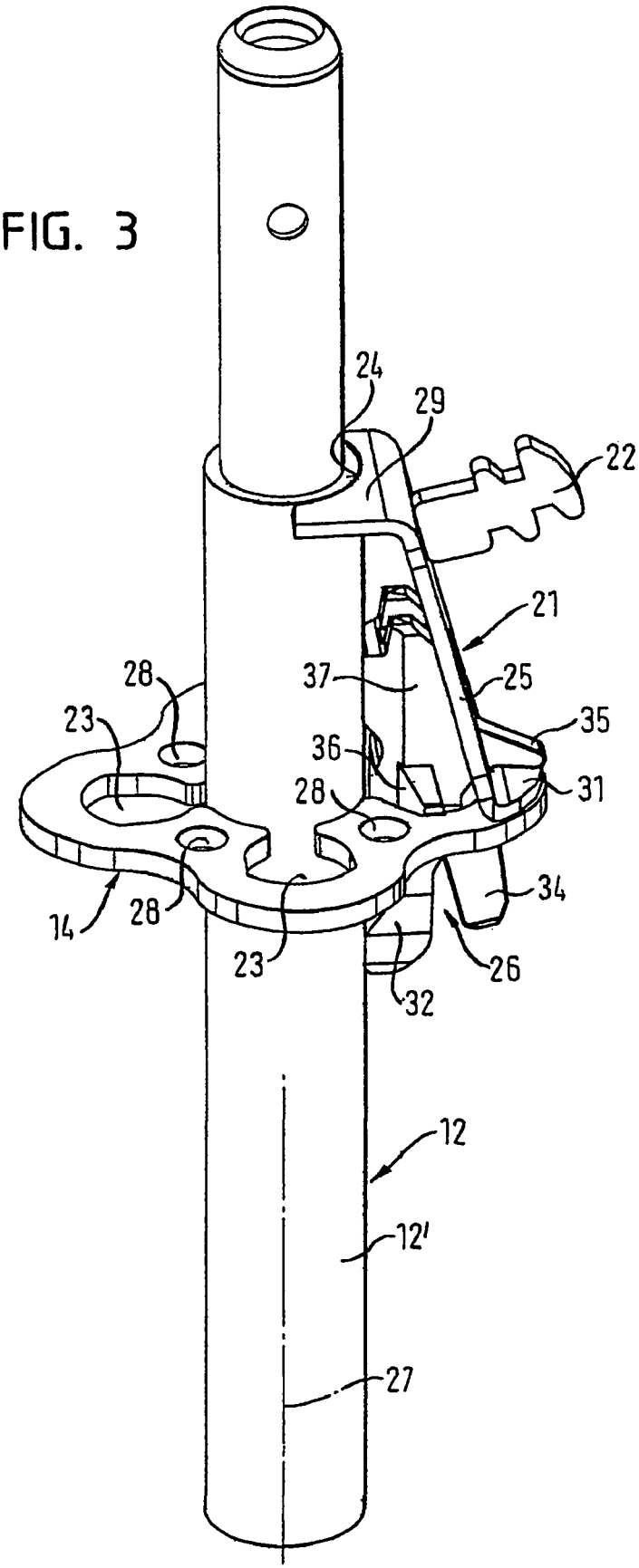
FIG. 3 is an enlarged perspective view of a vertical support section with a rosette and a railing adapter in accordance with the invention attached thereto obliquely from above.
Figure 4:
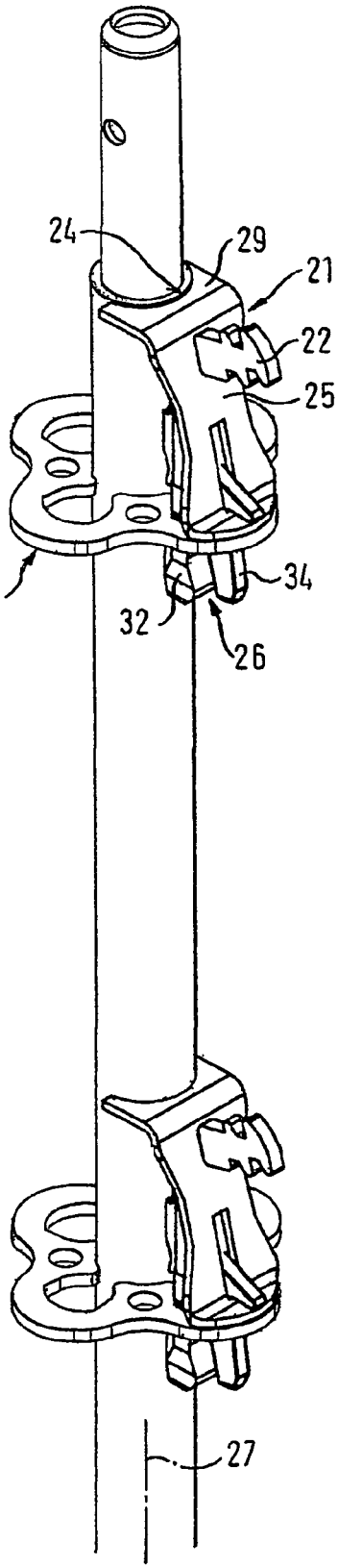
FIG. 4 is a perspective view of a vertical support section with two rosettes which are arranged above one another and to which a railing adapter in accordance with the invention is attached in each case.

In accordance with FIGS. 1 and 2, a dismantlable scaffold has vertical supports 12, 13 consisting of individual sections 12', 13' of a length, for example of 2 m or 3 m, which support rosettes 14 extending around them at predetermined, preferably equal vertical spacings of e.g. 0.5 m.

Four pairs of two vertical supports 12, 13 lying sequentially are arranged at equal lateral spacings and deck support bars 15 are hung into associated rosettes 14 between them at specific vertical spacings of e.g. 2 m. The deck support bars 15 serve for the hanging in of elongate, rectangular decks 11 on which persons can walk.

The ends of rod-shaped railing elements 16, 17, which are intended to secure persons working on the decks 11 from falling, are fastened to the rosettes 14 of adjacent vertical supports 12 at the front side of the scaffold above the decks 11. Whereas two railing elements 16, 17 lying above one another provide a higher degree of safety, generally just one single railing element 16 above each deck 11 would be sufficient to secure the persons working on the decks 11.

In each case, first a deck 11 is attached above the deck support bar 15 to rosettes 14 lying above one another, then a first railing element 17 and a second railing element 16. The rosette 14 lying above it has no function.

The scaffold furthermore has diagonal posts 20 at specific positions at the front side which can extend from one of the rosettes 14 of the vertical supports 12 to rosettes 14 of an adjacent vertical support 12 arranged further below or above.

In accordance with FIGS. 1 and 2, the bottommost vertical support sections 12', 13' are made substantially shorter than the sections lying above them; they represent the base of the scaffold and are connected by deck support bars 15 which do not, however, have to support any deck. Height-adjustable spindles 52 are provided between the bottommost rosettes 14 and the ground plates 51 serving for support on the ground for the purpose of compensating ground irregularities; they are not shown in FIG. 1 for reasons of clarity. In accordance with FIG. 1, horizontal bolts 18 are fastened above the ground plates 51 or spindles 52 between the rosettes 14 of adjacent vertical supports 12, 13 for the stabilization of the scaffold in the region of the lower deck support bars 15.

The facade scaffold shown by way of example in FIG. 1 has a substructure F which cannot be walked on and three stories A, B and C above it which can be walked on due to the decks 11. The stories A, B and C are terminated at the right-hand side by end face rails 19.

As can be seen from FIG. 2, the second front vertical support section 12' (seen from below) is two rosette spacings 14 longer than the second rear vertical support section 13', whereas the other vertical support sections 12', 13' located above it are all made equally long and each bear four rosettes 14. This design is important for the attachment of the railing elements 16, 17 in accordance with the invention, because it is thereby possible, starting from an already prepared deck 11, to bring a front vertical support 12' into such a vertical position by placing on the already completed part of the vertical support 12 a railing element 16 that can be hung from below onto a railing adapter 21 provided at the topmost rosette 14 in accordance with FIGS. 3 to 6.

Since no railing elements are required or can also be introduced later with the rear vertical supports 13 in the case of application shown, the rear vertical support sections 13' can each end directly above a deck support bar 15, whereas the front vertical support sections 12' each extend upwardly above each deck support bar 15 by two rosette spacings.

In accordance with FIGS. 3 to 6, the rosettes 14 have four relatively large profiled holes 23 at an angular spacing of 90° in each case relative to the vertical support axis 27 and relatively small circular holes 28 therebetween.

The large holes 23 serve for the fastening of the deck support bars 15 and of the railing elements 16, 17 by means of a railing adapter 21 in accordance with the invention, whereas the small holes 28 can be used e.g. for the holding of the ends of the diagonal posts 20.

Figure 5:
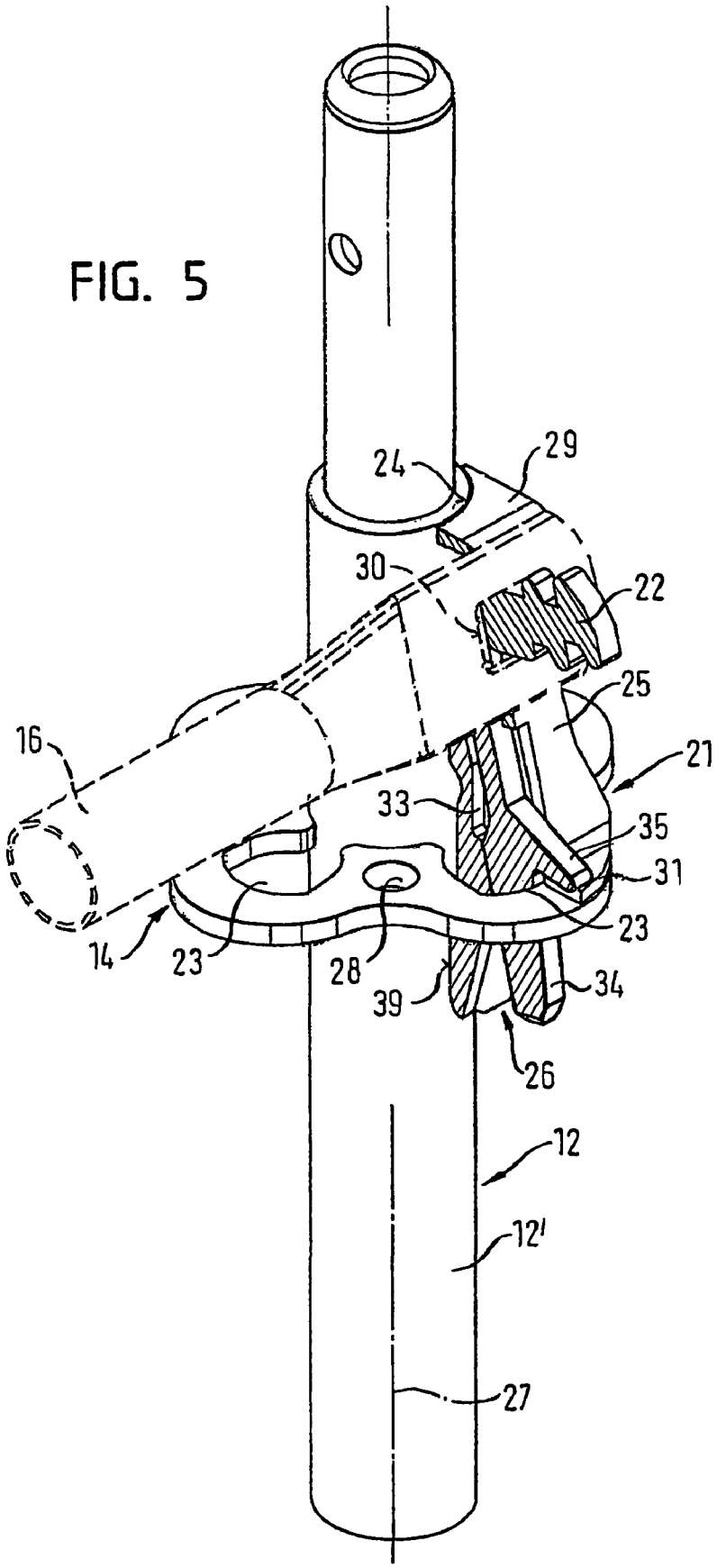
FIG. 5 is a perspective part view similar to FIG. 3, with, however, the wedge mechanism of the railing adapter being shown cut open and with a railing element being indicated by a broken line.
Figure 6:
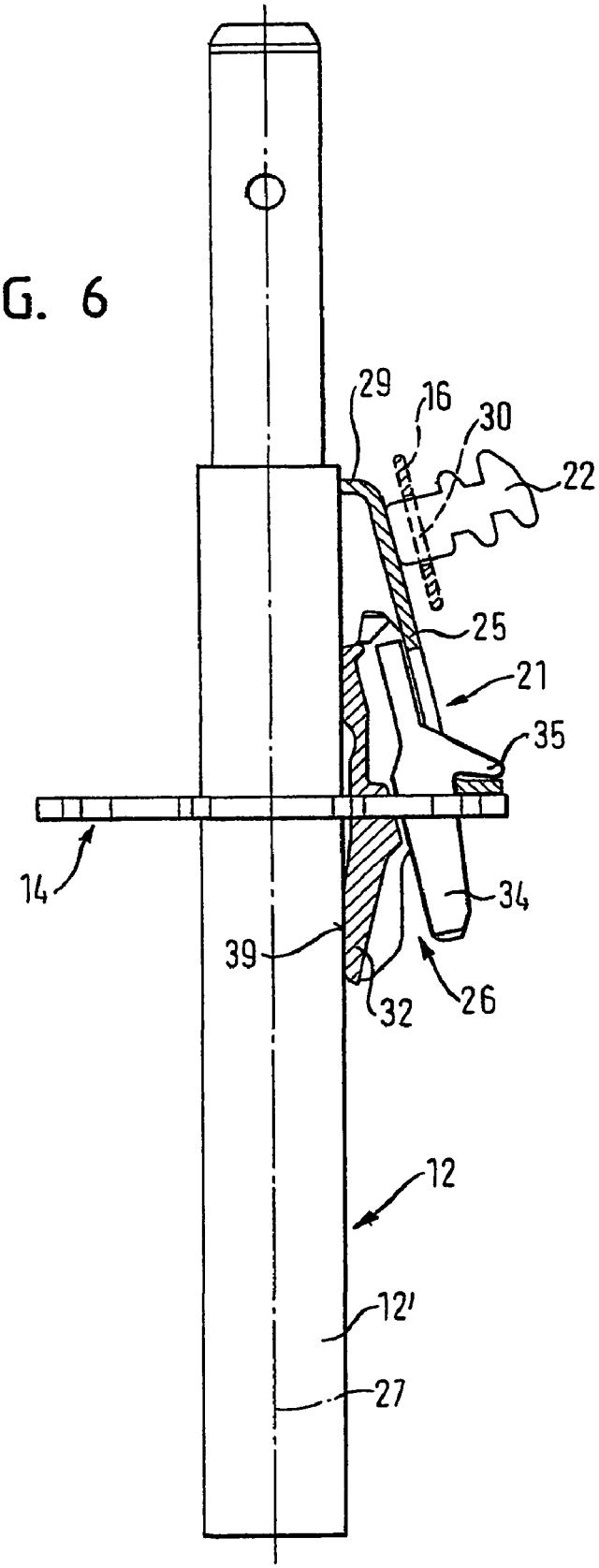
FIG. 6 is a side view of the subject of FIG. 5 in the direction of the railing element with a partial section.
Figure 7:
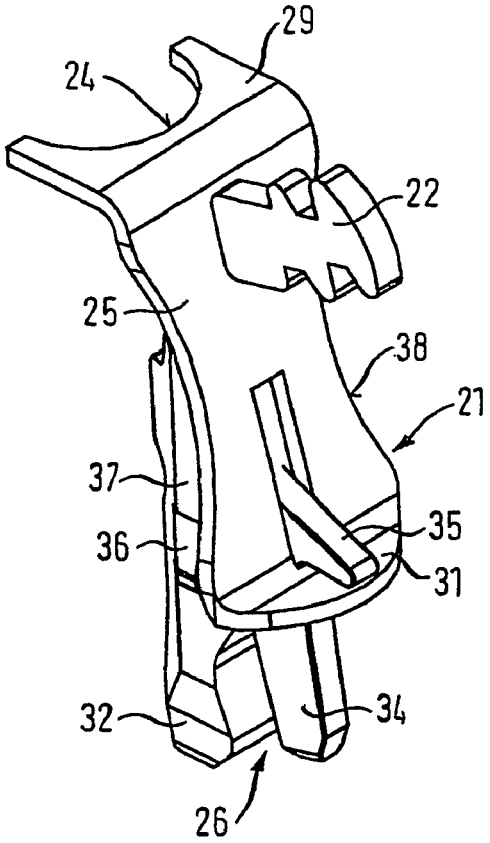
FIG. 7 is a perspective view of a railing adapter in accordance with the invention obliquely from the front.
Figure 8:
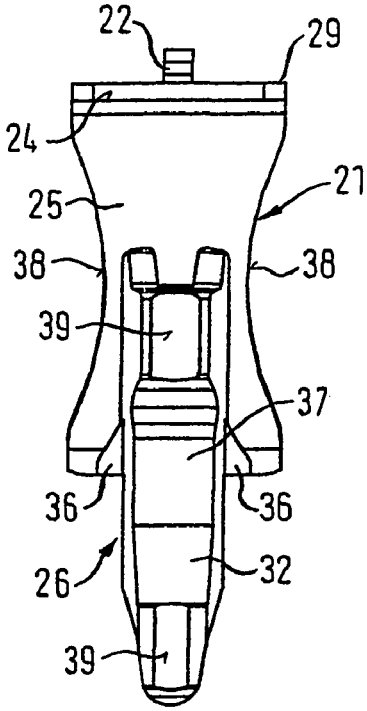
FIG. 8 is a rear view of the railing adapter in accordance with the invention.
Figure 9:
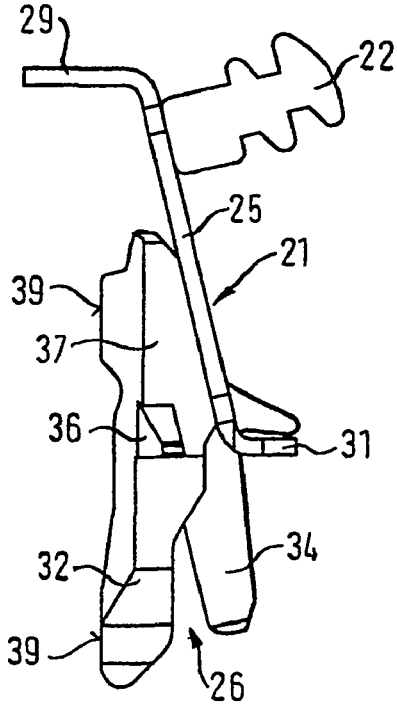
FIG. 9 is a side view of the railing adapter in accordance with the invention.
Figure 10:
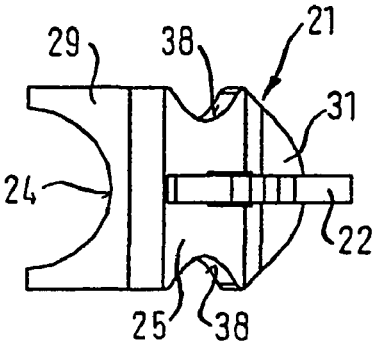
FIG. 10 is a plan view of the railing adapter in accordance with the invention.

Whereas, in accordance with the prior art shown in FIGS. 1 and 2, the ends of the railing elements 16, 17 are hung directly into the holes 23 of the associated rosettes 14 by means of suitably designed hooks, in accordance with the present invention and as shown in FIGS. 3 to 6, the railing adapter 21 shown in detail in FIGS. 7 to 10 is hung into a hole 23 at the inner side of the external vertical supports 12 and consists of a flat strip 25 extending obliquely upwardly from below to the vertical support 12 of a hook and wedge mechanism 26 arranged thereon and having a housing 37 formed as a solid base body and of a railing holding element 22 which extends inwardly away upwardly substantially perpendicular from the flat strip 25 and to which, in accordance with DE 196 33 092 A1, a railing element 16 having a hang-in opening 30 at each end is attached as is indicated by broken lines in FIGS. 5 and 6.

The flat strip 25 has an angling 29 at the top which is directed to the vertical support 12 and has at the side extending toward the vertical support 12 a support surface 24 which corresponds to the outer contour of the vertical support 12 and contacts the periphery of the vertical support 12 in the fitted state. The flat strip 25 is provided at the bottom with an inwardly extending support angling 31 which lies on the upper side of the rosette 14 in the fitted state.

The wedge mechanism 26 consists of a wedge hook 32 hung into the associated hole 23 and of a wedge 34, which is displaceable in a groove 33 thereof, the wedge hook and the wedge being designed and operating in accordance with EP 0 876 541 B1. An inwardly extending projection 35 is provided at the wedge 34 and prevents the wedge 34 from falling out in the unfitted state of the railing adapter 35 and permits a subsequent hammering tight of the wedge 34 on the fitting of the railing adapter 21. The wedge 34 can ultimately be hammered so far in by the hammering tight that it lies on the upper side of the support angling 31.

The housing 37 of the hook and wedge mechanism 26 is upwardly supported on the rosette 14 on both sides via support projections 36 and rearwardly at the vertical support 12 via upper and lower support surfaces 39.

The function of the railing adapter 21 in accordance with the invention is as follows:

The railing adapter 21 is placed from the top onto the rosette 14 at the desired position, with the wedge hook 32 penetrating into the opening 23, but with the wedge 34 being supported at its lower end on the upper side of the rosette 14 outside the hole 23 and being upwardly displaced in the groove 33 relative to the wedge hook 32 in this process.

The wedge hook 32 is inserted so far into the hole 23 that the support angling 31 and the support projections 36 contact the upper side of the rosette 14. Shortly beforehand, the lower end of the wedge 34 enters into the region of the hole 23 so that the wedge 34 can be downwardly moved by hammering tight and/or due to gravity into the fastening position shown in FIGS. 3 to 6, where it is wedged with the rosette 14, with the projection 35 being able to lie on the support angle 31. The railing adapter 21 is now secured at the vertical support 12 in accordance with EP 876 541 B1, and a railing element 16 can be attached to the railing holding element 22 in accordance with DE 196 33 092 A1 until it adopts the position indicated by broken lines in FIGS. 5, 6. The railing adapter 21 in accordance with the invention is therefore first secured at the rosette 14 and at the associated vertical support 12 (or 13) and thus becomes an integral component of the vertical support. Only subsequently is the railing element 16 then attached to the railing holding element 22 as with a vertical support directly fitted with the railing holding element 22. The railing adapter 21 in accordance with the invention is then fastened to the rosette 14 independently of the railing element 16.

The invention claimed is:

1. A dismantlable scaffold having decks which can be walked on and are arranged in a plurality of stories and having a plurality of vertical supports which support them, the vertical supports including a plurality of sections which can be slipped onto one another, being arranged spaced apart from one another, being connected at predetermined vertical spacings by deck support bars and carrying rosettes at predetermined vertical spacings, with one or more railing elements for connecting the vertical supports being attachable to rosettes of adjacent vertical supports above a deck, wherein the railing elements can be hung onto a railing holding element from the deck lying below it, said railing holding element being arranged on a railing adapter which is secured to the associated rosette independently of the railing element and, when attached to the rosette, supports the railing holding element above the rosette whose spacing from the rosette is smaller than the spacing of two vertically adjacent rosettes, wherein the railing adapter has a flat strip which supports the railing holding element in its upper region and which has a support surface above the railing holding element for the contact with the associated vertical support, and wherein the flat strip is closer to the vertical support in its upper region than in its lower region and includes an angle of 10° to 30° with the axis of the vertical support.

2. A scaffold according to claim 1 wherein the angle is approximately 20°.

* * * * *